US009713406B2

(12) United States Patent
Abdollahzadeh

(10) Patent No.: US 9,713,406 B2
(45) Date of Patent: Jul. 25, 2017

(54) TOILET SEAT CONTROLLER

(71) Applicant: Homayoun Abdollahzadeh, Rancho Mirage, CA (US)

(72) Inventor: Homayoun Abdollahzadeh, Rancho Mirage, CA (US)

( * ) Notice: Subject to any disclaimer, the term of this patent is extended or adjusted under 35 U.S.C. 154(b) by 203 days.

(21) Appl. No.: 14/311,628

(22) Filed: Jun. 23, 2014

(65) Prior Publication Data

US 2015/0366418 A1 Dec. 24, 2015

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1, 246.3, 246.4, 246.5
See application file for complete search history.

(56) References Cited

U.S. PATENT DOCUMENTS 1,291,125 A * 1/1919 Pope ..... A47K 13/10 4/246.2
2,214,323 A 9/1940 Carter
2,986,745 A 6/1961 Melzassard
3,825,958 A 7/1974 Higginson
4,055,864 A * 11/1977 Liu ..... E03D 5/04 4/246.1
5,119,517 A * 6/1992 Chang ..... A47K 13/302 4/233
5,289,593 A 3/1994 Lawrence
5,307,524 A * 5/1994 Veal ..... E03D 5/10 4/246.1
5,323,497 A * 6/1994 Lih ..... A47K 13/10 297/DIG. 10
5,400,442 A 3/1995 Pendlebury
5,570,478 A 11/1996 Armstrong
5,819,327 A 10/1998 Miller
6,915,532 B1 * 7/2005 Mohammed ..... A47K 13/10 4/246.1
7,380,292 B1 * 6/2008 Harris ..... A47K 13/10 4/213
7,636,956 B1 * 12/2009 Doucet ..... A47K 13/10 4/246.1
9,477,317 B1 * 10/2016 Clements ..... G06F 3/017
2007/0056084 A1 * 3/2007 Watt ..... A47K 13/10 4/246.1
2008/0271231 A1 * 11/2008 Stauber ..... A47K 13/305 4/246.1
2009/0106885 A1 * 4/2009 Sagre ..... A47K 13/10 4/246.1
2010/0313343 A1 * 12/2010 Kang ..... A47K 13/10 4/246.1

(Continued)

FOREIGN PATENT DOCUMENTS

CA 2772957 A1 3/2012
WO 98/31269 7/1998

(Continued)

*Primary Examiner* — J. Casimer Jacyna
(74) *Attorney, Agent, or Firm* — Knobbe Martens Olson & Bear, LLP

(57) ABSTRACT

An apparatus capable of moving a toilet seat from one position to another in a number of ways including, but not limited to, a switch, voice recognition software, infrared remote control, a motion detector, and a mobile device application. A lifting structure is attached under the seat and is connected to a housing containing a motor and/or a microprocessor.

17 Claims, 7 Drawing Sheets

(56) References Cited

U.S. PATENT DOCUMENTS

| | | | | |
|---|---|---|---|---|
| 2012/0167292 | A1* | 7/2012 | Baumoel ..... | A47K 13/10<br>4/246.1 |
| 2012/0246812 | A1 | 10/2012 | Blum | |
| 2015/0366419 | A1 | 12/2015 | Abdollahzadeh | |

FOREIGN PATENT DOCUMENTS

| | | |
|---|---|---|
| WO | 2004/100745 | 11/2004 |
| WO | 2009/054862 | 4/2009 |
| WO | 2014/036523 | 3/2014 |

* cited by examiner

TOILET SEAT CONTROLLER

BACKGROUND OF THE INVENTION

Field of the Invention

The invention disclosed herein relates generally to electronic devices attachable to, and capable of moving, toilet seats. The invention relates specifically to a system capable of moving a toilet seat between a first open position and a second closed position upon receiving commands.

Description of Related Art

Toilet seats are unclean at best and a harbor for disease at worst. A man wishing to use a toilet runs the risk of infection and illness, as does a woman faced with having to put the seat down if a man with whom she is sharing the premises forgets to do so. To avoid having to do this, it is desirable to have at one's disposal a device that can be attached to a toilet seat. More importantly, it is desirable to have a device that can also be manipulated at will should the device or the entire toilet need to be cleaned or repaired. The prior art discloses a number of devices that seek to achieve these objectives.

For example, U.S. Pat. No. 5,289,593 to James Lawrence discloses a seat-closure device that involves weight-driven cords or cables that move the toilet seat when the toilet is flushed. U.S. Pat. No. 5,400,422 to James Pendlebury discloses a hydraulic motor-driven device that also lowers the toilet seat upon flushing. Other patents disclose various methods to affix similar devices to a toilet that utilize, for example, springs, or movement based on the water line in the tank, among others, to restore the toilet seat to its original position.

Unfortunately, the prior art overwhelmingly favors simplistic methods such as cables with weights and water markers. Two issues arise as a result of these methods. First, many necessarily require a tank. This requires more labor to install and remove the device and it also makes the functioning of the device dependent on the functioning of the tank. Second, even if the prior art devices do not require a tank to work, they cannot be retrofitted onto an existing toilet, instead requiring a new seat to be installed. While these methods certainly fulfill the purpose of moving the seat from one position to another during routine use, they do not address the need for manipulating the seat at will should the user need to wash or repair the toilet or the device.

SUMMARY OF THE INVENTION

The invention that is the subject of this application overcomes the shortcomings of the prior art by providing the user with a number of convenient ways to control the seat's movement that include both motion-based methods and methods that involve more direct control of the device.

The disclosed invention comprises an apparatus for controlling the movement of a toilet seat. A housing contains a microprocessor and a motor and is coupled to a toilet seat. The housing is also coupled to, or rests on the toilet base. The motor stores and uses energy to move, such as bias, the toilet seat from a first open position to a second closed position. A tongue is affixed beneath a toilet tank and anchors the housing in place. A lifting structure in communication with the motor is affixed beneath the toilet seat and to the housing.

BRIEF DESCRIPTION OF THE DRAWINGS

The invention will be more fully understood by reference to the following drawings which are for illustrative purposes only.

DETAILED DESCRIPTION

Figure 1:
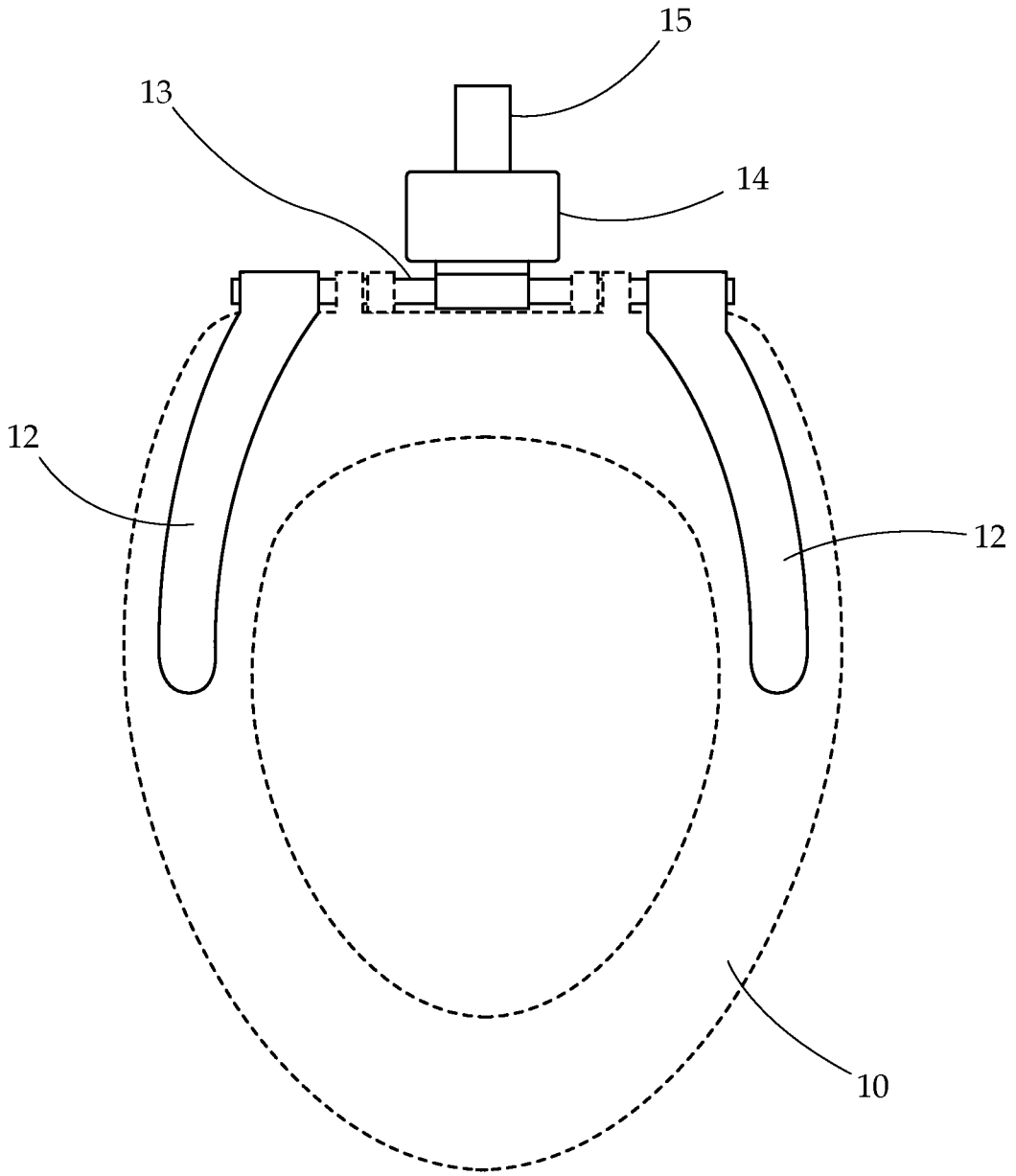
FIG. 1 provides a top plan view of a standard toilet seat and one embodiment of the disclosed invention with the position of the arms affixed to the seat in phantom lines.
Figure 2:
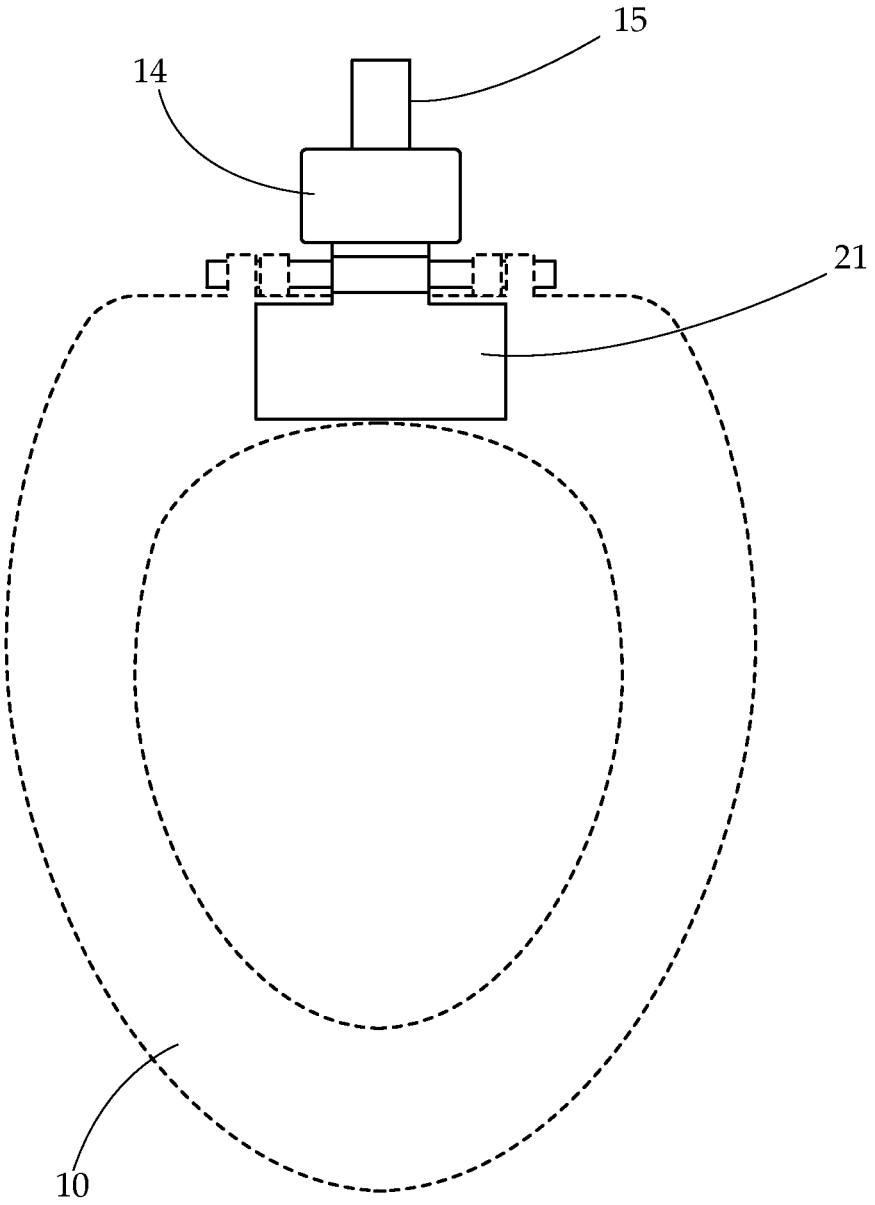
FIG. 2 provides a bottom plan view of one embodiment of the disclosed invention showing the motor, the tongue, and a cuboid-shaped lifting structure attached to the bottom of the seat.

The detailed description set forth below in connection with the appended drawings is intended as a description of presently preferred embodiments of the invention and does not represent the only forms in which the present invention may be constructed and/or utilized.

The invention comprises a device configured to open and close a toilet seat. The device is configured to be attached to a toilet having a base, a bowl, a tank, and the toilet seat movable from a first open position to a second closed position. The device comprises a housing, containing a motor and an optional microprocessor. The housing is connected to a lifting structure attachable to the base of any standard toilet seat such that it is entirely, or mostly, not visible. This lifting structure is attachable to the seat by any means including, but not limited to, Velcro®, adhesives, threaded connections, and mounted brackets. It is an important feature of the present invention that it can be installed allowing existing toilets to be retrofitted with the invention. As long as the lifting structure supports the toilet seat's weight, it can be shaped in any desired manner including, but not limited to, a cuboid-shaped block, arms that extend from the motor to a desired point on the seat base, or a crescent.

Attached to the housing on the side opposite the side to which the lifting structure is attached is a tongue that is placed under the tank to keep the housing in place while the seat is in motion. In addition, the housing is also affixed to the rear portion of the toilet seat by any means including, but not limited to, Velcro®, adhesives, threaded connections, or mounted brackets. The microprocessor has the ability to respond to commands to lower or raise the seat in at least three ways: A switch mounted near or on the toilet, a motion detector, and voice recognition software. The user can elect to use any of these methods to operate the device. However, it should be understood that any input may be used to activate the motor without straying from the scope of this invention.

Referring now to FIGS. 1-9, the present invention is powered by a motor that acts upon commands delivered to a microprocessor. The motor and/or the microprocessor are in a housing 14 that is affixed to the rear section of the toilet base, near the tank. The housing 14 comprises a lifting structure 12, 21, 31, that connects the seat 10 to the housing 14. The lifting structure may be affixed to the seat 10 by any means including, but not limited to, Velcro®, adhesives, threaded connectors, and mounted brackets. In alternative embodiments, the user's choice of affixation can be determined by a number of factors. First, ease of installation and removal. Velcro® and adhesives are quicker methods of installation than threaded connections or mounted brackets. Second, and closely related to the first factor, is the degree to which the user wishes the device to be permanently attached to the toilet. Velcro® is a less permanent method of affixation than threaded connections, for example.

Attached to the opposite side of the housing 14 is a tongue 15 connected to the housing and extends into a space underneath the tank and above the base, such as in the crevice underneath the tank and above the body of the toilet. The tongue 15 serves to anchor the housing 14 in place when the seat 10 is in motion and being acted on by the motor engine. The tongue 15 can be coupled to the housing 14 by any means necessary to enable the device and the seat 10 to achieve the full range of motion. For example, in one embodiment the housing 14 may include a crevice of any shape but sufficiently large to accommodate the portion of the tongue 15 with which it is coupled. A pin may be installed within this crevice and holes corresponding to the pin's diameter may be drilled through the tongue's 15 rear portion. The tongue 15 will be affixed to the pin allowing the housing to rotate about the pin. By way of example only, and for purposes of further demonstration to those of skill in the art, this particular embodiment is based on largely the same principle as the functioning of a clevis pin. In another embodiment, the tongue 15 could also be an integrally formed extension of housing 14.

In another embodiment, the tongue 15 may be coupled to the housing 14 by installing it in a crevice designed to accommodate a range of motion of at least 90°. The tongue 15 can then be coupled directly to the housing 14 by way of, for example, a threaded connection such as nuts or screws, or by rotating about a pin that is installed through that anterior portion of the tongue 15 and anchored in the crevice of the housing 14. The connection will hold the tongue 15 in place while allowing the housing to rotate.

Figure 3:
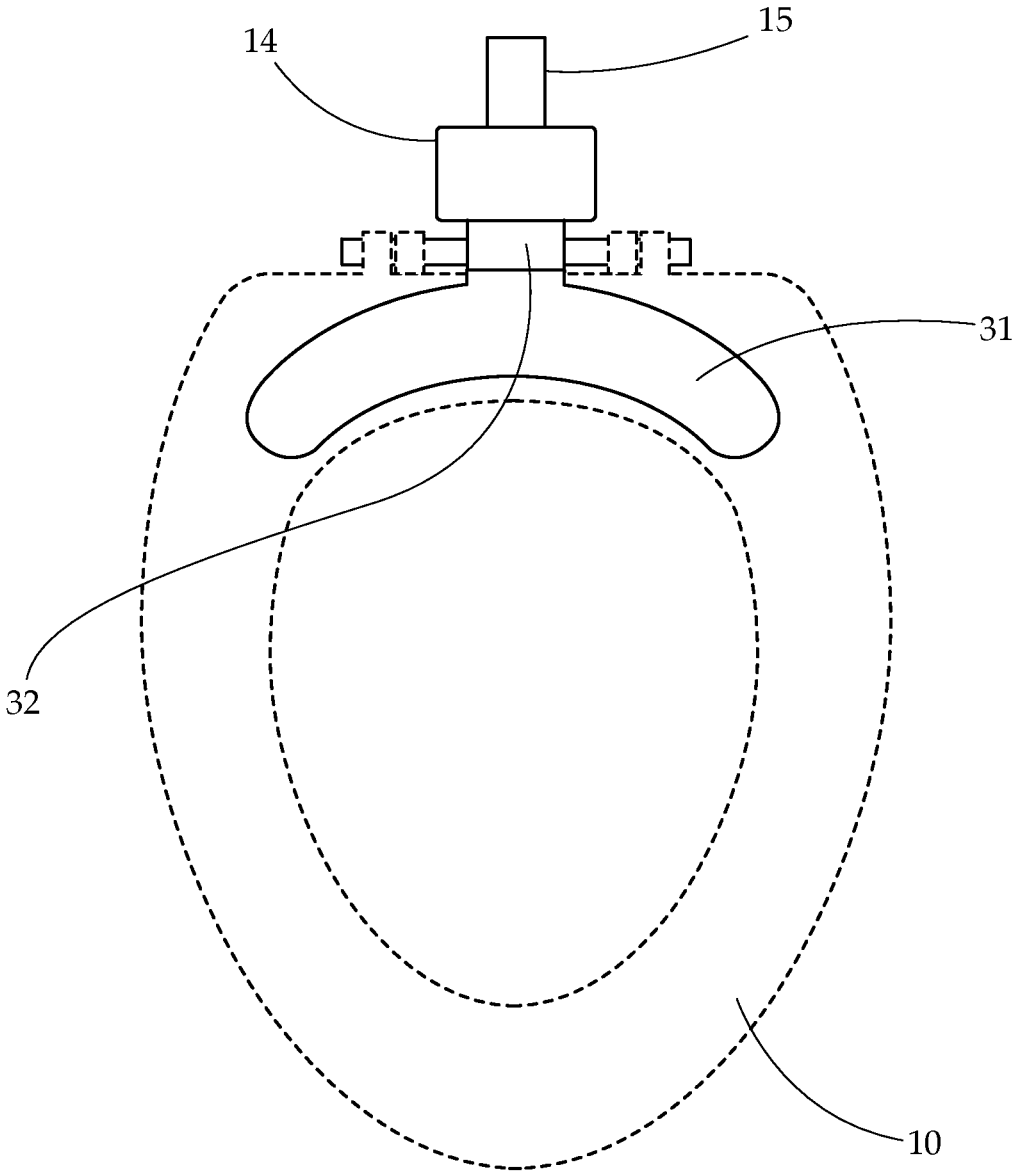
FIG. 3 provides a bottom plan view of another embodiment of the disclosed invention showing the motor, the tongue, and a crescent-shaped lifting structure attached to the bottom of the seat.
Figure 4:
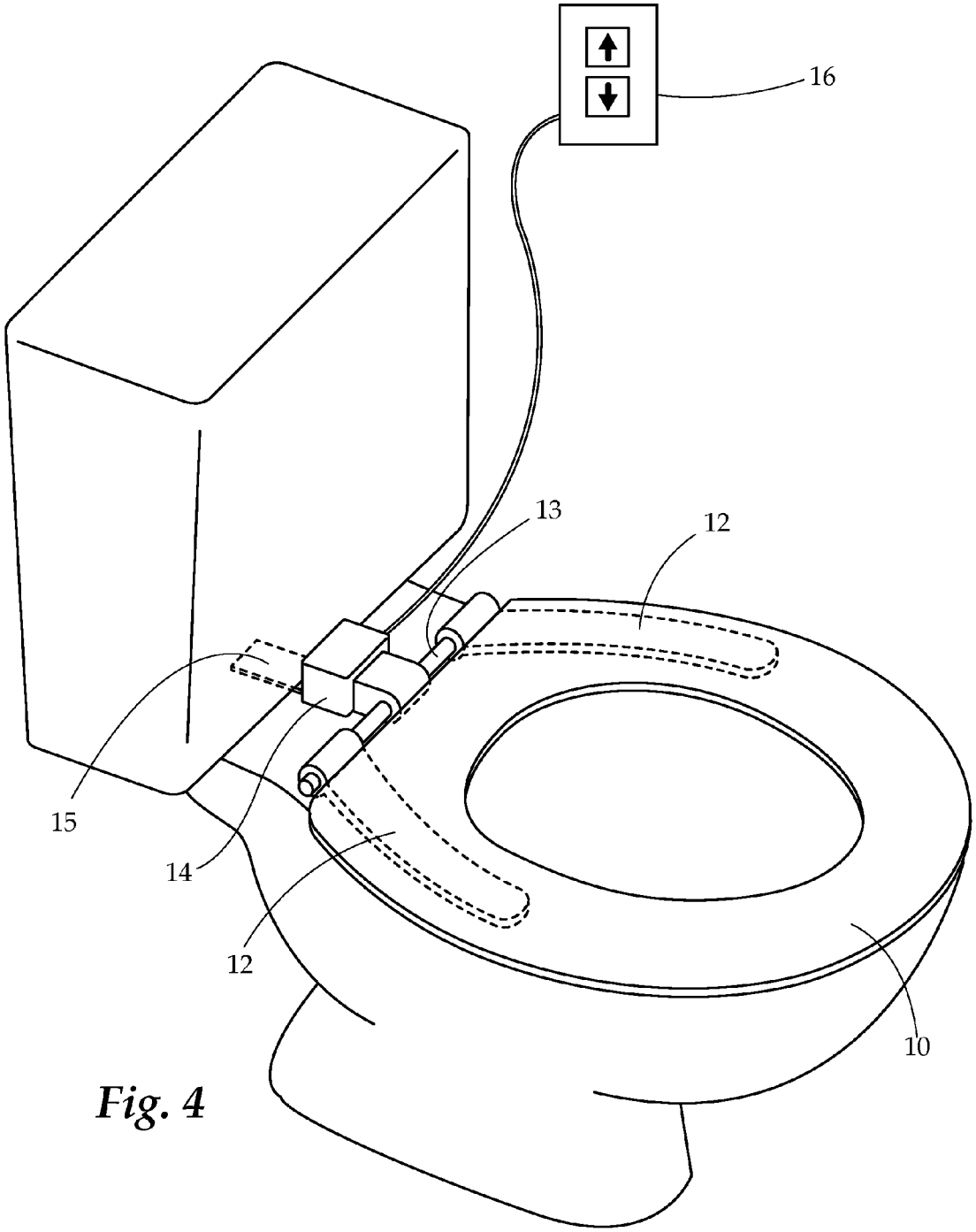
FIG. 4 provides a perspective view of an embodiment of the present invention.
Figure 5:
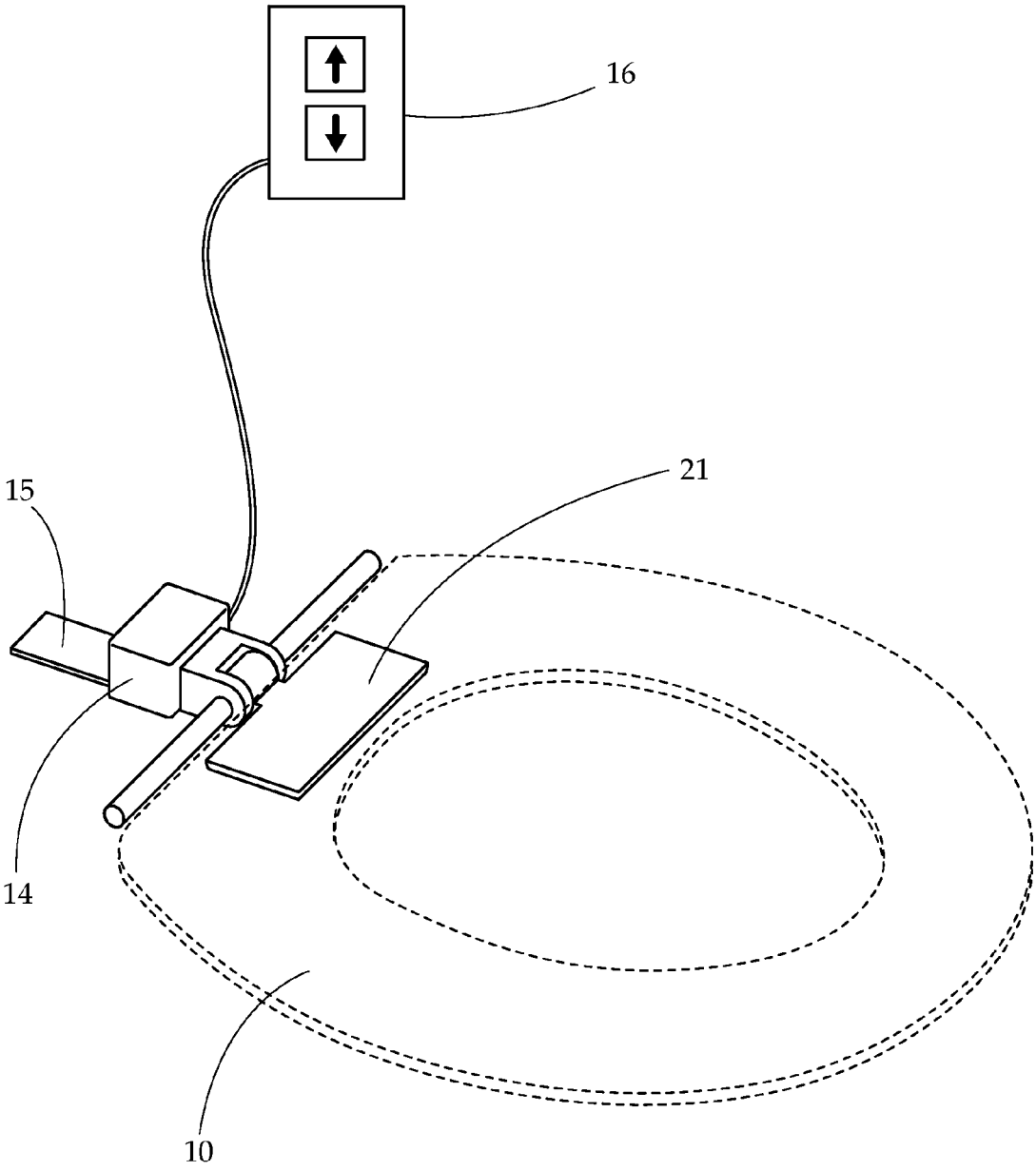
FIG. 5 provides a perspective view of still another embodiment of the present invention.
Figure 6:
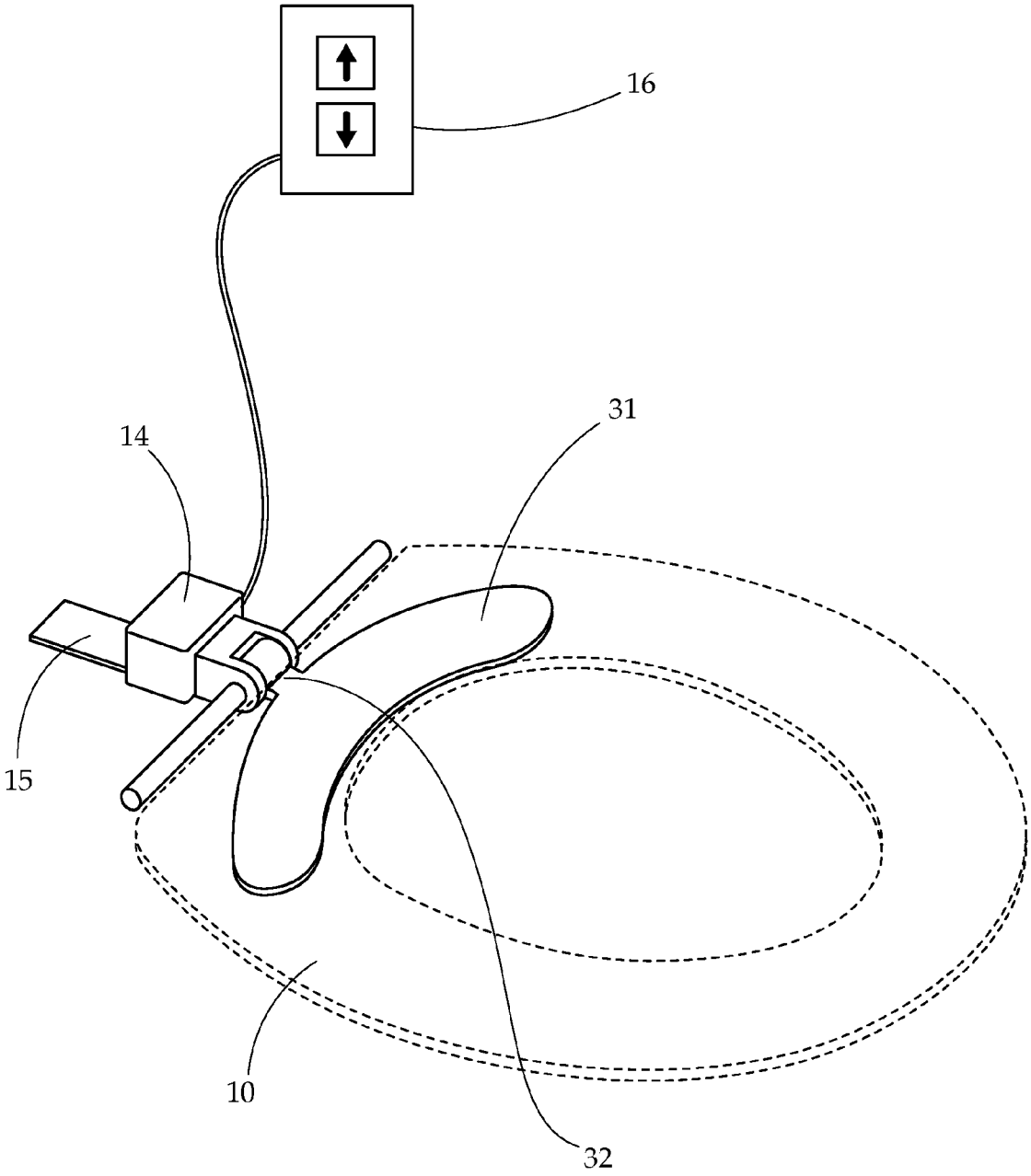
FIG. 6 provides a perspective view of another embodiment of the present invention.
Figure 7:
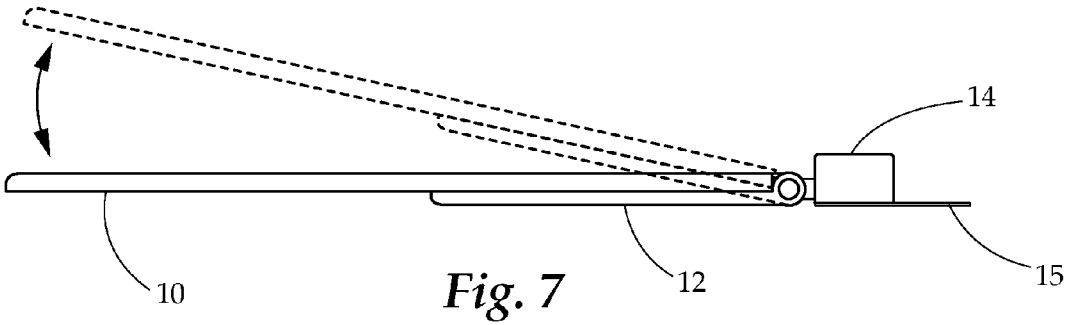
FIG. 7 provides a side view of another embodiment of the present invention.
Figure 8:
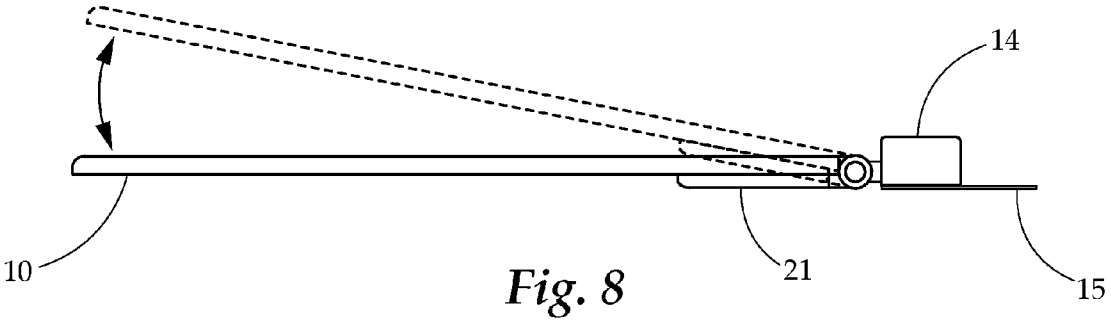
FIG. 8 provides a side view of another embodiment of the present invention.
Figure 9:
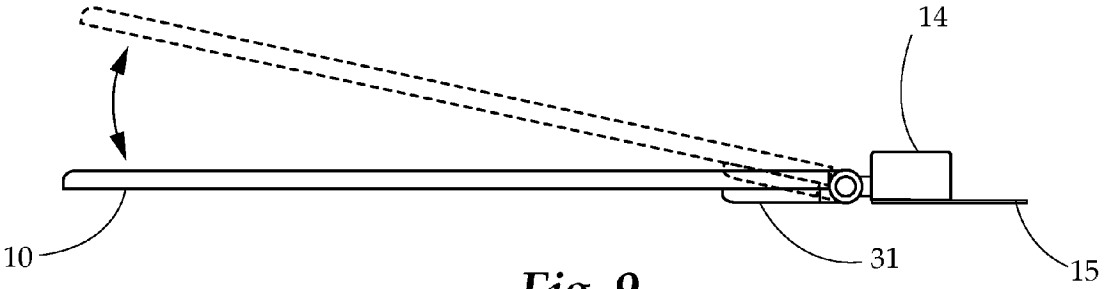
FIG. 9 provides a side view of another embodiment of the present invention.

Those of ordinary skill in the art will appreciate that despite the anchoring of the housing 14 as described above, the lifting structure will need to be constructed such that the housing 14 can be securely attached to it. This is necessary to minimize physical stress on the housing 14 and the lifting structure. FIGS. 1, 4, and 7 display one embodiment containing a bar 13 connecting the lifting structure 21 to the housing 14, the lifting structure 12 connecting the bar 13 and the seat 10. FIGS. 3, 6 and 9 displays another embodiment containing this bar 32 in between the housing 14 and the seat 10. Those of skill in the art will note the significant difference in size between bars 13 and 32 in these embodiments. Regardless of the bar or other connector's size, it may be attached to the housing 14 on one side and the lifting structure 12, 21, 31 on the other by any suitable method. For example, the housing 14 can be attached to the lifting structure which is formed as a bar or rectangular plate that contains the method of affixation to the back of the seat 10 on one side. In one embodiment, the housing 14 can be attached by threaded connectors to part of the lifting structure, which is a bar of suitable rigidity and material with a certain number of mounted brackets that are attachable to the seat 10. In another embodiment, the housing 14 can be attached by threaded connections to a bar of suitable rigidity and material and the bar contains one side of a number of adhesive patches with corresponding adhesive patches attachable to the back of the seat 10. It should be understood, however, that the lifting structure may be attached to the housing by any means without straying from the scope of this invention, so long as the lifting structure and is allowed to be moved approximately 90 degrees between the open and closed positions by the motor of the housing. The bar's length can be as desired and its width can be wider than the back of the seat 10 to ensure there is enough room for, both, the chosen method of affixation and the point at which the lifting structure is to be attached.

In one embodiment, an upper portion of one side of the bar or rectangular plate is devoted to the chosen method of affixation while the lower portion is devoted to attaching the lifting structure. The dimensions of the bar, the location of the method of affixation, and the location of the lifting structure will depend on the structure of the particular toilet and its seat 10 as well as the choice of lifting structure.

The lifting structure can be any shape or size suitable to support the weight of a standard toilet seat 10. Those of skill in the art will appreciate that a toilet seat 10 is not particularly heavy, which allows a vast choice of materials and shapes to be used to manufacture the lifting structure. In one embodiment, illustrated in FIGS. 1, 4, and 7, the lifting structure consists of two arms that extend a certain distance outward. In another embodiment, illustrated in FIGS. 2, 5, and 8, the lifting structure 21 is a rectangle or cuboid. In yet another embodiment, illustrated in FIGS. 3, 6 and 9, the lifting structure 31 is a crescent shape. In each embodiment, the lifting structures are attachable to the toilet seat 10 by any suitable method including but not limited to Velcro®, adhesive, threaded connectors, or mounted brackets.

The seat 10's movement can be controlled in a variety of ways. In one embodiment, the housing 14 does not contain a microprocessor and the mode of operation is a simple switch/sensor button. In another embodiment, a microprocessor in the housing 14 may be responsible for receiving commands and performing the desired operation. The microprocessor can be programmed to receive commands in at least three ways: A switch mounted near the toilet, a sensor, and voice recognition. A user can select the method of command by any appropriate method common to such technology, including, but not limited to, pressing a button on the housing 14 corresponding to the desired mode of operation or turning a dial installed in the housing 14 that corresponds to the desired mode of operation.

If the user should choose a switch as the primary mode of operation, the switch can be mounted on the wall nearest to the toilet, for example. A two-switch embodiment 16 is illustrated in FIG. 4. In this embodiment, one switch can be used to raise the seat 10 while the other can be used to lower it. In another embodiment, a single switch can be used to start movement and can be pressed again to stop movement when desired or when the seat 10 completes its full range of motion. This may help the user to stop the seat's 10 movement when and where desired to facilitate cleaning or repair. The switch 16 can be mounted by any appropriate means including but not limited to adhesives, Velcro®, or suction cup technology.

If the user chooses the sensor as the primary mode of operation, then a motion detector, infrared sensor, wireless transceiver, or the like, built into the housing 14, or separate and in communication with the microprocessor, will detect and respond to various inputs. The wireless transceiver contemplated herein may use any sort of wireless communication technology such as radio frequencies including WiFi, Bluetooth® and the like. This may be a particularly suitable mode of operation for routine use as opposed to a situation in which the user wishes to clean or repair the toilet or the seat 10. The wireless communication may be integrated into a smartphone, tablet, or other computer so that a computer-based application may control the activation of the toilet seat cover, making it movable up and down.

If the user chooses voice recognition as a primary mode of operation then the seat 10 will respond to simple voice commands. In one embodiment, users can record spoken commands into a recording device built into the housing 14, each of which can correspond to a particular movement. For example, the command "Down" will lower the seat 10, the command "Up" will raise the seat 10, and the command "Stop" will cause the seat 10 to remain in the position it was in when the user uttered the command "Stop." Alternatively, programmed voice recognition software may be used in communication with the microprocessor, stored in a memory, to accept verbal commands without voice recording or other specific training.

It will be understood by those skilled in the art that additional modes of command may be programmed into the microprocessor and incorporated into the system. One example is remote control technology. Another example is mobile application software. A user can transmit commands to the microprocessor in any method appropriate, including, but not limited to, using a touch-screen to control the movement of the seat or issuing verbal commands directly into a mobile device, which will then relay the command to the microprocessor. This particular mode of command is particularly useful if the user wishes to raise or lower the seat 10 when outside the restroom. For example, the user may require the seat 10 to be raised before he enters the restroom or may remember that he forgot to lower the seat 10 only after he leaves the restroom.

In yet another embodiment, at least one light-sensitive light-emitting diode (LED) will be built into the housing to illuminate the device if the user happens to be using the facility in the dark. In order to save power, the LED may be in communication with the motion detector such that it will emit light only when a user is about to use the facility in the dark.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A toilet seat assembly for controlling the movement of a toilet seat comprising:

a toilet having a base, a bowl, a tank, and the toilet seat moveable from a first open position to a second closed position;

a housing coupled to the toilet seat and the base, the housing containing a microprocessor and a motor configured to move the toilet seat between the first open position and the second closed position;

a lifting structure coupling the toilet seat to the housing;

a tongue connected to the housing and extending into a space between the tank and the base;

a switch in communication with a circuit in the microprocessor, the microprocessor being configured to operate the motor in response to the switch; and wherein the microprocessor is in communication with a mobile device configured to transmit commands to the microprocessor to move the toilet seat between the first open position and the second closed position, and to move the toilet seat to a third desired position between the first open and the second closed position.

2. The toilet seat assembly of claim 1 wherein the lifting structure is removably attached to the toilet.

3. The toilet seat assembly of claim 1 wherein the lifting structure is retrofitted to an existing toilet.

4. The lifting structure of claim 1, wherein the lifting structure is crescent-shaped.

5. The toilet seat assembly of claim 1, wherein the housing contains an infrared sensor configured to respond to a remote control, the infrared sensor being in communication with the motor.

6. The toilet seat assembly of claim 5, wherein the infrared sensor is configured to initiate movement of the toilet seat in response to a command from the remote control.

7. The toilet seat assembly of claim 1, wherein the motor stores energy for biasing the toilet seat to the first open position or the second closed position.

8. The toilet seat assembly of claim 1, wherein the microprocessor is configured to carry out the steps of:

processing and recording human speech; and activating the motor to move the toilet seat to the first open position or the second closed position.

9. The toilet seat assembly of claim 1, wherein the microprocessor is in communication with a motion detector and configured to respond to the presence of a user and to move the toilet seat to one of the first open or second closed positions.

10. The toilet seat assembly of claim 1, wherein the switch is attachable to a wall.

11. The apparatus of claim 1, wherein the lifting structure is attached below the toilet seat such that it is not visible when the seat is in the second closed position.

12. The toilet seat assembly of claim 1, wherein the lifting structure contains a light-emitting diode.

13. The toilet seat assembly of claim 12, wherein the light-emitting diode is in communication with the microprocessor.

14. The toilet seat assembly of claim 1, wherein the housing contains an infrared sensor configured to respond to a remote control, the infrared sensor being in communication with the motor.

15. The toilet seat assembly of claim 14, wherein the infrared sensor is configured to initiate movement of the toilet seat in response to a command from the remote control.

16. The toilet seat assembly of claim 15, wherein the microprocessor is in communication with a motion detector and configured to respond to the presence of a user and to move the toilet seat to one of the first open or second closed positions.

17. The toilet seat assembly of claim 16, wherein the lifting structure contains a light-emitting diode.

* * * * *